US009595800B2

(12) United States Patent
Ott et al.

(10) Patent No.: US 9,595,800 B2
(45) Date of Patent: Mar. 14, 2017

(54) RING ELECTRODE FOR A SLIP RING

(71) Applicant: GAT Gesellschaft fur Antriebstechnik mbH, Geisenheim (DE)

(72) Inventors: Stephan Ott, Wiesbaden (DE); Harry Schilling, Schwabach (DE); Robert Raum, Geisenheim (DE); Dennis Hoff, Mainz (DE); Ronald Suchanecki, München (DE)

(73) Assignee: GAT Gesellschaft fur Antriebstechnik mbH (DE)

( * ) Notice: Subject to any disclaimer, the term of this patent is extended or adjusted under 35 U.S.C. 154(b) by 0 days.

(21) Appl. No.: 14/441,619

(22) PCT Filed: Nov. 13, 2013

(86) PCT No.: PCT/EP2013/073678
§ 371 (c)(1),
(2) Date: May 8, 2015

(87) PCT Pub. No.: WO2014/079743
PCT Pub. Date: May 30, 2014

(65) Prior Publication Data

US 2015/0295376 A1 Oct. 15, 2015

(30) Foreign Application Priority Data

Nov. 23, 2012 (DE) ..... 10 2012 111 381

(51) Int. Cl.
*H01R 39/14* (2006.01)
*H01R 39/08* (2006.01)
(Continued)

(52) U.S. Cl.
CPC ..... *H01R 39/14* (2013.01); *H01R 39/025* (2013.01); *H01R 39/08* (2013.01); *H01R 39/10* (2013.01);
(Continued)

(58) Field of Classification Search
CPC ..... H01R 39/14; H01R 39/10; H01R 39/385; H01R 39/08; H01R 39/20; H01R 39/26
(Continued)

(56) References Cited

U.S. PATENT DOCUMENTS 3,153,163 A * 10/1964 Foldes ..... H02K 13/00 200/263
3,343,636 A * 9/1967 Donelan ..... F16D 28/00 192/18 B
(Continued)

FOREIGN PATENT DOCUMENTS

FR 2099939 A1 1/1972
WO 2012028992 A1 3/2012

OTHER PUBLICATIONS

A. Witemann-Regis, Translation of International Preliminary Examination Report for PCT/EP2013/073678, International Bureau of the World Intellectual Property Organization, May 28, 2015.
(Continued)

*Primary Examiner* — Abdullah Riyami
*Assistant Examiner* — Harshad Patel
(74) *Attorney, Agent, or Firm* — Paul & Paul

(57) ABSTRACT

The invention relates to a ring electrode for a slip ring for transmitting electrical energy between machine parts, of which at least one machine part can be rotated in relation to another machine part. The ring electrode and corresponding slip ring can be economically produced and have low wear. The electrode is made of a rod material made of stainless steel, which is rolled into a ring and the free ends of the ring are brought together to form a closed ring.

12 Claims, 3 Drawing Sheets

(51) Int. Cl.

| | |
|---|---|
| ***H01R 43/10*** | (2006.01) |
| ***H01R 39/02*** | (2006.01) |
| ***H01R 39/10*** | (2006.01) |
| ***H01R 39/20*** | (2006.01) |
| ***H01R 39/26*** | (2006.01) |
| ***H01R 39/38*** | (2006.01) |

(52) U.S. Cl.
CPC ..... *H01R 39/20* (2013.01); *H01R 39/26* (2013.01); *H01R 39/385* (2013.01); *H01R 43/10* (2013.01)

(58) Field of Classification Search
USPC ..... 439/26, 672, 868; 310/232, 267, 241, 310/229, 228
See application file for complete search history.

(56) References Cited

U.S. PATENT DOCUMENTS 3,616,589 A * 11/1971 Sherlad ..... E04C 5/012 52/659
4,447,752 A * 5/1984 Boyce ..... H01R 39/24 310/232
5,612,584 A * 3/1997 York ..... H01R 39/08 310/232
2002/0171313 A1* 11/2002 Queener ..... H01R 43/10 310/232
2003/0137210 A1 7/2003 Southall
2004/0169434 A1* 9/2004 Washington ..... H01R 39/24 310/232
2006/0226728 A1* 10/2006 Pal ..... H02K 7/1884 310/180
2010/0013348 A1* 1/2010 Carvalho ..... H01R 39/08 310/232

OTHER PUBLICATIONS

The State Intellectual Property Office of the People's Republic of China, Appl. No. 201380061223.2, Office Action, Aug. 2, 2016, and English translation.

* cited by examiner

RING ELECTRODE FOR A SLIP RING

CROSS-REFERENCE TO RELATED APPLICATION

This is a national stage 371 application of International Application No. PCT/EP2013/073678, filed Nov. 23, 2013.

The present invention concerns a ring electrode for a slip ring for the transmission of electrical energy between machine parts, of which at least one is rotatable relative to another.

EP 2 426 793 discloses a contact brush ring system for a synchronous motor activated by current comprising ring electrodes according to the subject-matter of claim 1. In order to limit the wear to the wear of the brush, if possible, Cu or Cu alloys, CuZn, CuSn, Ag or Ag alloys, Au or Au alloys, steel or a coating made of Ni or Co or made of galvanized Au coating, respectively, are considered as materials for the ring electrodes.

Further examples for contact brushes and closed ring electrodes in motors or generators, respectively, are disclosed in FR 2.088.839, US 2002/1071313 and US 2003/0137210.

Corresponding slip rings are used on a large number of rotating machines, in particular when they are electrically driven, like for example machine tools, certain types of electric motors and the like. In particular slip rings with ring electrodes of larger diameter are typically also used in computer tomographs.

In that case such slip rings serve not only for the transmission of drive energy but also for the transmission of electrical signals. In the case of a slip ring circular or annular contact slip tracks which are referred to herein as 'ring electrodes' are mounted to a first machine part. Disposed on a second machine part is a slip contact which is in contact with a certain contact pressure with the slip track or the ring electrode. One of the two machine parts is rotatable relative to the other so that the slip contact moves along the entire periphery on the surface of the ring electrode and in that case remains in constant electrical contact with the ring electrode. In that arrangement the electrodes can be in contact selectively with the outer or inner peripheral surface of the ring electrode, but they can equally well also be in contact with a side surface of the ring, which (in the case of a flat ring) has the advantage that that contact surface is within the same plane. In principle the ring electrode can be of any cross-section, but right-angled cross-sections are preferred as they afford flat contact surfaces for the slip contacts.

In that way electrical energy and signals can be transmitted through the direct galvanic contact between ring electrode and slip contact and thus between machine parts which are rotatable relative to each other.

Various technologies are known for the mechanical structure of such slip systems. In general solid slip tracks of brass or bronze are combined with a slip contact of graphite or silver graphite, which are then used in particular for the transmission of direct or alternating currents of medium or higher power (that is to say from some 100 W to about 120 W). In the field of signal transmission involving small radii recourse is frequently also made to a combination of gold-plated slip tracks and gold-plated contact spring wires. The present invention however is primarily directed to ring electrodes and slip rings, with which electrical energies are transmitted, which however does not exclude transmission of electrical signals, possibly also in parallel with electrical energy transmission.

Graphite contacts and carbon brushes for corresponding slip contacts are known in numerous variations from the state of the art.

In accordance with the state of the art corresponding ring electrodes typically comprise brass or bronze. They are usually produced by severing individual rings from a tube of suitable diameter or by cutting them out of solid plates, for example by means of a laser.

The combination of brass or bronze slip tracks with graphite or silver graphite contacts involves a disadvantage in the relatively high degree of wear of the contact materials, which leads to a correspondingly short service life for the transmission system. The manufacture of high-quality slip rings and contacts is in that case relatively expensive as the material of the ring contacts must be very homogeneous for that arrangement and the slip contacts require a high proportion of silver. Less expensive variants frequently have a considerable transfer resistance and suffer from very high wear so that the electrical power which can be transmitted and the service life are limited thereby.

In addition the manufacture of conventional ring electrodes is relatively complicated and costly and linked to a considerable loss of material when the ring electrodes for example are cut out of solid plates, but even if individual rings are cut from a tube material, in which case then a considerable post-treatment operation is still also required to deburr and smooth the cut-out or cut-off rings.

In comparison with that state of the art the object of the present invention is to provide ring electrodes and corresponding slip rings as well as a method of manufacture thereof, which avoid at least one of the above-mentioned disadvantages. The aim in that respect is inter alia simple manufacture and a lesser amount of wear in use of the ring electrodes and corresponding slip rings. In addition or alternatively the invention seeks to reduce contact noise and also transfer resistance. The ring electrode and a corresponding slip ring should be suitable in particular for use in computer tomographs and similar medical equipment for the representation of body cross-sections and should preferably be optimised for that purpose.

At least a part of the above-mentioned object is attained by a ring electrode, the electrode comprises a rod or bar material of high-quality steel which is rolled to give a ring and the free ends of which are brought together to form a closed ring, wherein the diameter of the ring electrode lies within a range of between 40 cm and 2 m.

An advantage of manufacturing an electrode from a rod material of high-quality steel is inter alia that practically no or only a very small degree of material cutting wastage occurs as the rod material only has to be cut to the length required for a ring. Such rod material is frequently also wound on to rolls of large diameter and is thus available practically in the form of endless material.

In that respect the term 'rod material' is used to mean any material of constant cross-section and of a length which is at least a hundred times the diameter. In particular the term 'rod material' also includes wire cross-sections from 16 $mm^2$ to cross-sections of for example 30×30 $mm^2$ without any limitations intending to be linked to those cross-sectional details.

In that respect it is in particular possible with suitable rolling installations to produce rings of diameters of between about 40 cm and 1.5 m or 2 m with a good degree of accuracy, that is to say with very good roundness of the ring. Rod material of right-angled cross-section is particularly preferred as it affords the possibility of producing slip tracks which easily permit good surface contact with the slip contacts.

The free ends of the rod shaped to form a closed ring then bear in butting relationship against each other. Desirably the rod is also embedded in an insulating plastic carrier material so that at most there remains a gap which is negligible for practical purposes between the free ends of the rod bent into a ring shape.

In that respect such a plastic carrier material should desirably be so selected that it has a coefficient of thermal expansion which is as identical as possible to that of the ring electrode made from high-quality steel. In particular the coefficient of thermal expansion should be in the region of an operating and transport temperature at between −40 and +80° C. at least within a factor of 2 in the region around the coefficient of thermal expansion of high-quality steel.

The rod or the rod material which is used for manufacture of a specific ring should preferably have a certain slight over-length because that makes it possible to place the free ends of the rod which is rolled overall to form a ring over each other and to bring same to the desired length along a miter cut. That ensures in any case a good overlap for a slip contact sliding over the butt seam. It is possible to avoid increased wear at the butt join by embedding and fixing of the ring electrodes and the free ends thereof and possibly smoothing the transitional region.

In addition the free ends of the ring, which lie against each other, can also be self-evidently welded together or brazed together.

In the case of a miter cut the corresponding weld seam does not extend precisely radially with respect to the ring axis, but markedly inclined relative to the radial direction.

The region of a weld seam on the ring electrode is preferably smoothed by milling, turning or grinding so as to avoid excessive wear of the slip contacts in the region of the weld seam.

Optionally the ring can also be annealed in the region of the weld seam by heating to a certain degree so that that region has substantially the same friction properties for the slip contacts as the remaining part of the ring electrode.

A corresponding slip ring for the transmission of electrical energy between a stationary and a rotating machine part, which has an insulating carrier material which is also in the shape of a ring is characterised according to the invention in that the slip ring has at least one ring electrode of the above-described kind. Preferably the electrode is embedded into the carrier material of the slip ring and has only a slight projection beyond a corresponding surface of the carrier material.

It will be appreciated that a slip ring can also have a plurality of ring electrodes of the above-described kind. In an embodiment the plurality of ring electrodes of a slip ring are of different diameters and they are arranged concentrically in a common radial plane, that is to say in a plane perpendicular to the common ring axis.

In another embodiment however it is also possible for the plurality of ring electrodes each to be of the same diameter and arranged parallel in a common cylindrical surface of the ring-shaped or cylinder-shaped carrier material. It will be appreciated that, besides the at least one ring electrode of high-quality steel according to the invention, further ring electrodes can also be arranged on a slip ring, which comprise another conductive material, in particular brass.

The corresponding slip contacts or pick-up electrodes are in rubbing contact with the at least one ring electrode of high-quality steel and are preferably metal-bearing carbon electrodes. In particular carbon electrodes with a silver content of up to 60% or a copper content of up to 75% have proven to be suitable for the combination with high-quality steel ring electrodes.

In the preferred embodiment a respective plurality of carbon electrodes are arranged as slip contacts on a common pick-up rail in relation to a slip ring, for each ring electrode. In that way the available contact surface between ring and slip contact is markedly increased and the contact pressure and the friction emphasised thereby and the wear can be optimised in such a way that a patina which is ideal for transmission is formed. The slight initial wear of the stated material combinations in combination with surrounding moisture in the air leads to a coating on the ring electrodes with the slip contact material which has a markedly positive influence on the properties in regard to transfer resistance, contact noise and further wear characteristics.

The method according to the invention of producing corresponding ring electrodes was already implicitly described hereinbefore and it is characterised by using a rod material of high-quality steel, wherein the length of a corresponding high-quality steel rod at least corresponds to the periphery of the ring electrode to be produced, rolling the rod into a ring shape of the desired diameter, welding the free ends which have been brought together of the rod which is shaped to form a ring and smoothing milling or grinding the welded seam region on the surface of the ring which is welded together.

In that case, as already mentioned, preferably a rod material of right-angled cross-section is used.

The preferred materials for the high-quality steel of a ring electrode are for example high-quality steels with a high chromium and carbon content, as are available for example as steels of types X10Cr13 or X20Cr13.

Further advantages, features and possible uses of the present invention will be apparent from the description hereinafter of a preferred embodiment and the related Figures in which:

FIG. 1 shows a plan view of a diagrammatically illustrated ring 1 which comprises high-quality or stainless steel and the cross-section of which, for example as shown in FIG. 3, can be square of dimensions of 10×10 $mm^2$.

Figure 1A:
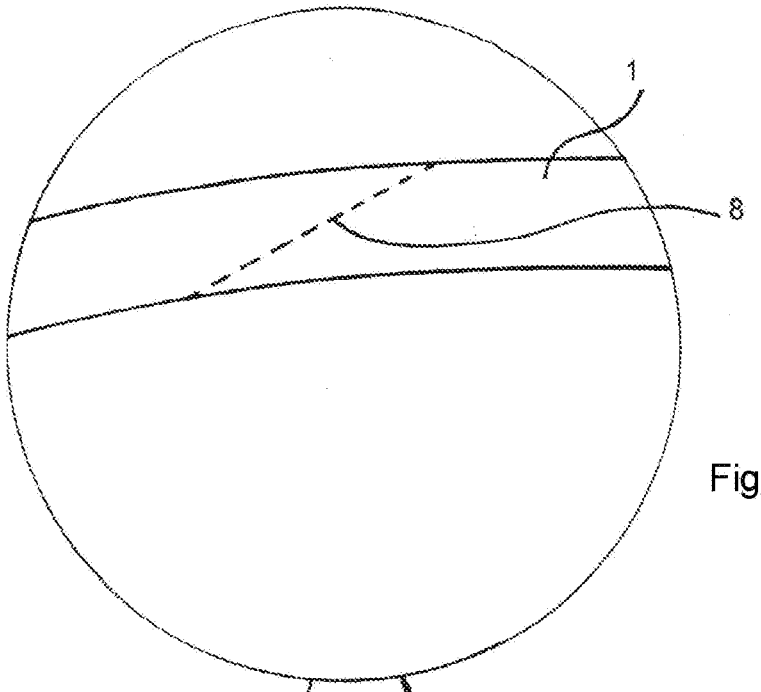
FIG. 1 show a plan view of a ring electrode and FIG. 1*a* shows a corresponding partial enlarged view in the region of a weld seam.
Figure 1:
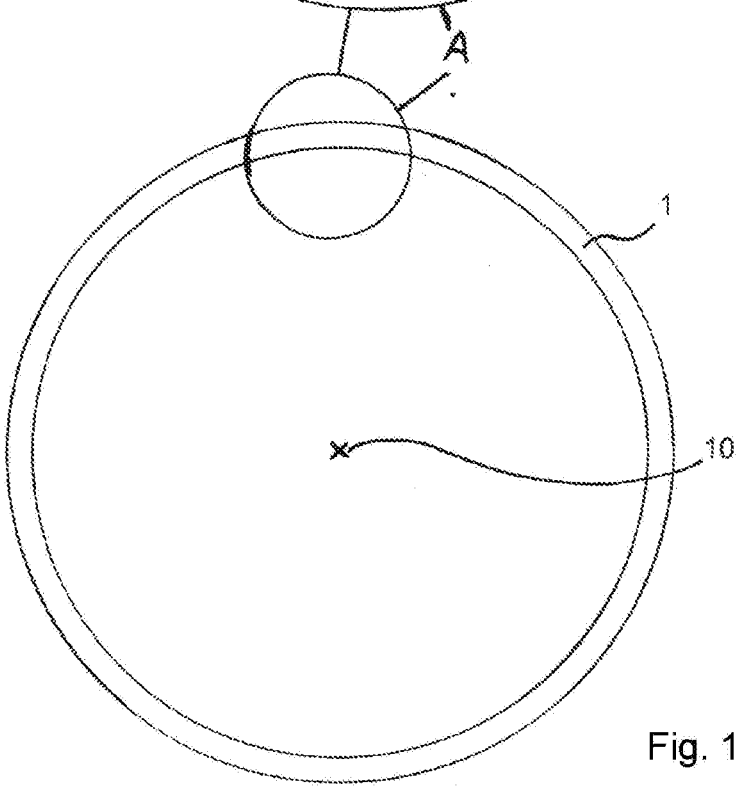

The portion A is shown on an enlarged scale in the upper part of FIG. 1 and diagrammatically indicates by means of a broken line a weld seam 8 which extends along a miter cut.

To produce such a cut a rod material with a slight over-length is used and is rolled to form a corresponding ring and the free ends which overlap somewhat because of the over-size are placed one over the other and then cut in a miter cut jointly along a line corresponding to the weld seam 8. The cut surfaces are then placed flush against each other and welded so that the weld seam 8 is of the configuration shown in FIG. 1. The surface of the ring is then smoothed by milling or grinding. The entire ring surface can possibly also be subjected to turning again when the ring electrode is gripped in a corresponding apparatus or embedded in the slip ring 20 shown in FIGS. 2 and 3.

Figure 2:
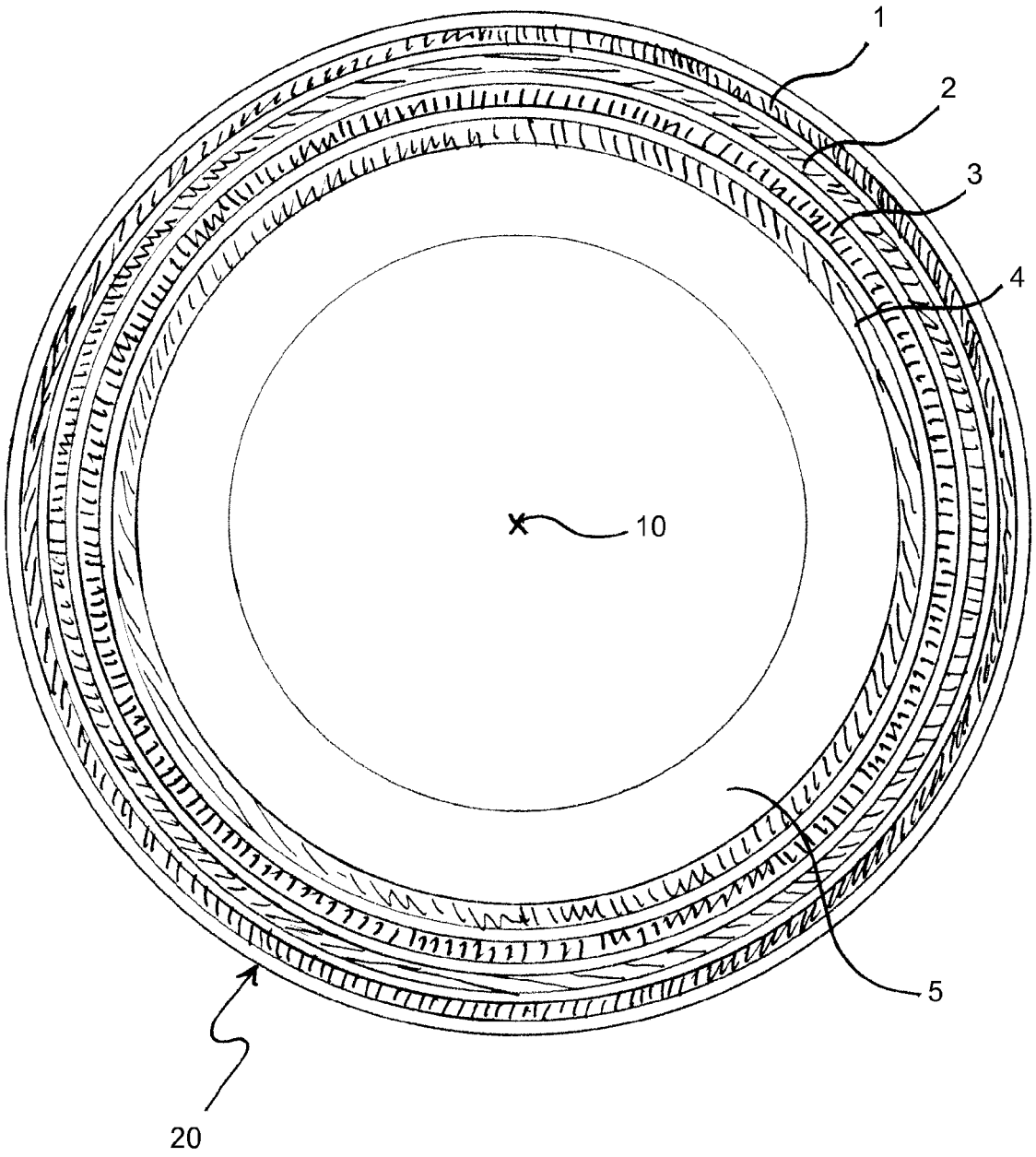
FIG. 2 shows a plan view of a slip ring.

FIG. 2 shows a plan view of a slip ring comprising a carrier disk 5 of ring shape, which is made from an insulating plastic material, preferably polyurethane, with a mineral filler, wherein the filler provides that the plastic material overall has a coefficient of thermal expansion which is of the order of magnitude of the thermal expansion of high-quality steel and at any event in the temperature range of interest of between −40° and 80° C. differs by less than a factor of 2 from the coefficient of thermal expansion of high-quality steel.

Figure 3:
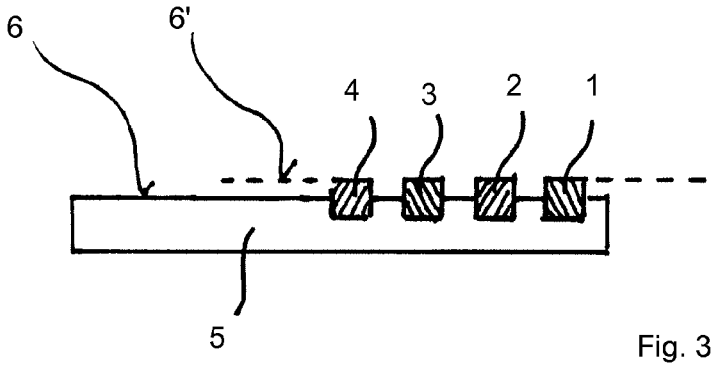
FIG. 3 shows a cross-section through a slip ring.

The carrier disk 5 has overall four embedded slip rings 1, 2, 3 and 4. The common axis 10 of the carrier disk 5 and the rings 1, 2, 3 and 4 is indicated at the center of the disk. FIG. 3 shows a cross-section through the carrier disk 5 with the four embedded ring electrodes 1, 2, 3 and 4 which project somewhat beyond the surface 6 which extends in a radial plane. The projection of the surfaces of the ring electrodes 1, 2, 3 and 4 relative to the surface 6 can for example be between 1 and 3 mm. The ring electrodes 1, 2, 3 and 4 which are of square cross-section are respectively embedded to more than half in the material of the carrier disk 5. The surfaces of the ring electrodes 1, 2, 3 and 4, that extend parallel to the radial plane 6, are in turn preferably smoothed, for example by grinding, turning or milling, and are disposed jointly in a plane 6' which is parallel to the plane 6 and which is indicated by a broken line.

Figure 4:
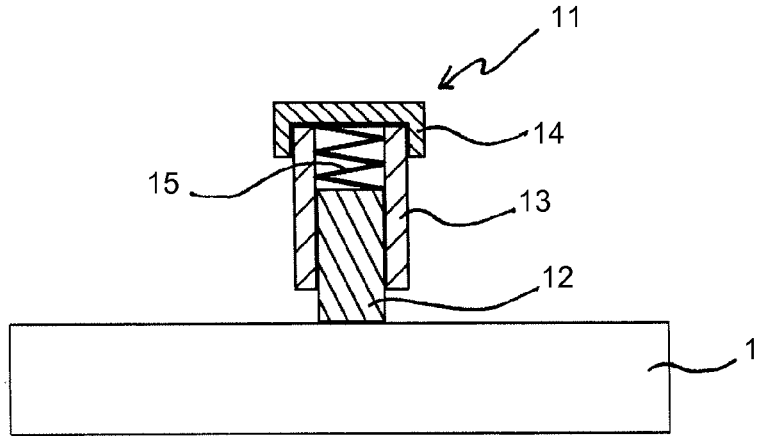
FIG. 4 shows a carbon brush in rubbing slip contact with a ring electrode.

FIG. 4 diagrammatically shows a side view of a ring electrode 1 which is in rubbing slip contact with a carbon brush 11, the carbon brush being shown again only diagrammatically in section. The carbon brush 11 overall comprises a metal-filled or metal-impregnated graphite block 12, a guide sleeve 13, a cap 14 and a spring 15 which holds the graphite block 12 in engagement with the surface of the ring electrode 1.

Figure 5:
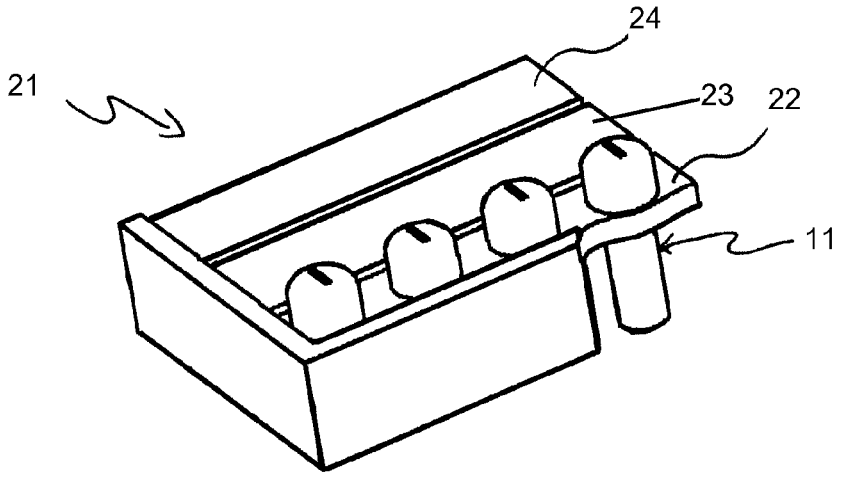
FIG. 5 shows a brush block for providing slip contacts with a plurality of ring electrodes.

The carbon brush 11 is typically mounted in a rail of a brush block 21, as shown in FIG. 5. Desirably the sleeve 13, the cap 14 and the spring 15 comprise an electrically conductive material, typically metal, and optionally a flat flexible contact lug or line can also be arranged between the spring 15 and the graphite block 12, being connected with a free end thereof to the cap 14 and/or the sleeve 13 to provide good electrical contact between the graphite block 12 and the sleeve 13 or cap 14.

As shown in FIG. 5 typically a plurality of carbon brushes 11 are connected to an electrically conducting contact rail 22 of a brush block 21, in specific terms each being accommodated in a suitably fitting bore in the contact rail 22. For example the sleeve 13 could be pressed or shrink-fitted into a bore in the rail, possibly also screwed or soldered, and in that way connected fixedly and electrically conductingly to the contact rail 22. A plurality of carbon brushes 11 arranged on the same contact rail 22 can come into rubbing slip contact with the same ring electrode 1 at the same time and one behind the other. The bores for receiving the carbon brushes 11 on the contact rail 12 can possibly follow the arcuate configuration of a ring electrode 1, when the ring electrode is of large diameters however that is generally not required as even carbon brushes arranged linearly on a short portion remain in contact with the ring electrode, in spite of a slight curvature of the ring electrode.

The adjacent contact rails 23, 24 are shown here without carbon brushes, but obviously in turn generally also carry carbon brushes 11 which come into contact with adjacent ring electrodes, for example the ring electrodes 2 and 3 in FIG. 3. It will be appreciated that the housing 25 of the brush block 21 is electrically insulating so that the individual contact rails 22, 23, 24 fixed thereto are electrically insulated from each other.

In operation the slip contacts are held in contact with the surface of the ring electrodes 1, 2, 3 and 4 under a spring bias, in which case either the carrier disk 5 with the ring electrodes 1, 2, 3 or 4 or however a machine part, to which the slip contacts are mounted, rotates about the common axis 10, in which case the slip contacts are continuously in contact with the surface of the ring electrodes 1, 2, 3 and 4 and in that way can continuously transmit electrical energy or power. By virtue of the preferred material pairing of high-quality steel for the ring electrodes 1, 2, 3 and 4 on the one hand and a silver graphite with up to 60% silver or a copper graphite with up to 75% copper, very good contact resistance, low contact noise and a high level of transmission efficiency between the stationary and the rotating machine parts is achieved by the formation of a patina, which is very good due to the materials involved.

The method according to the invention of producing the ring electrodes by rolling from high-quality steel also has inter alia the advantage that rings or ring electrodes of almost any diameter can be manufactured from one and the same rod material as long as the material can just be rolled to a desired diameter. In that respect there is almost no material cutting wastage (apart from the ends which are cut for example on the miter), the surfaces have and retain high quality and the material is extremely resistant to wear and presents only slight friction in relation to metal-bearing graphite electrodes so that the total wear of the system comprising slip ring and slip contact also remains extremely slight and at the same time excellent power data are achieved in relation to current-carrying capability and signal quality. In that way the ring electrodes and slip rings according to the invention are suitable in particular for use on imaging medical equipment with rotating pick-ups or sensors or radiation emitters.

For the purposes of the original disclosure it is pointed out that all features as can be seen from the present description, the drawings and the appended claims by a man skilled in the art, even if they are described in specific terms only in connection with certain other features, can be combined both individually and also in any combinations with others of the features or groups of features disclosed here insofar as that has not been expressly excluded or technical aspects make such combinations impossible or meaningless. A comprehensive explicit representation of all conceivable combinations of features and emphasis of the independence of the individual features from each other is dispensed with here only for the sake of brevity and readability of the description.

The invention claimed is:

1. A slip ring for the transmission of electrical energy between a stationary and a rotating machine part comprising an insulating carrier material in the form of a ring and at least one ring electrode mounted thereto, in particular embedded therein, the at least one ring electrode comprising a rod material of high-quality steel having free ends which is rolled to form a ring and the free ends of which are brought together to form a closed ring having a diameter in a range of between 40 cm to 2 m, metal-bearing carbon electrodes being provided as pick-up electrodes in rubbing contact with the at least one ring electrode of high-quality steel.

2. The slip ring as set forth in claim 1 characterised in that the metal-bearing carbon electrodes have a silver content of up to 60% or a copper content of up to 75%.

3. The slip ring as set forth in claim 1 wherein the at least one ring electrode is one of a plurality of ring electrodes and wherein a respective plurality of carbon electrodes are arranged on a common pick-up rail for each ring electrode.

4. The slip ring as set forth in claim 1 wherein the free ends of the rod material which is rolled to a ring shape are welded or brazed together.

5. The slip ring as set forth in claim 4 characterised in that the free ends of the rod material which is rolled to a ring shape are cut on a miter.

6. The slip ring as set forth in claim 1 characterised in that the rod material is of a rectangular cross-section of minimum dimensions of $5\times5$ $mm^2$ and maximum dimensions of $30\times30$ $mm^2$.

7. The slip ring as set forth in claim 1 wherein the insulating carrier material is a plastic carrier material whose coefficient of thermal expansion at an operating temperature of between −40 and 80° C. is within a factor of 2 in a region around the coefficient of thermal expansion of high-quality steel.

8. The slip ring as set forth in claim 1 wherein the at least one slip ring has a plurality of ring electrodes.

9. The slip ring as set forth in claim 8 characterised in that the plurality of ring electrodes are of different diameters and are arranged concentrically in a common radial plane.

10. The slip ring as set forth in claim 8 characterised in that the plurality of ring electrodes are respectively of the same diameter and are arranged parallel in a common cylindrical surface of the insulated carrier material.

11. The slip ring as set forth in claim 1 characterised in that besides at least one ring electrode of high-quality steel there are provided further ring electrodes of another conductive material.

12. The slip ring of claim 11 wherein the other conductive material is brass.

* * * * *